United States Patent [19]

Ghosh

[11] Patent Number: 4,922,213

[45] Date of Patent: May 1, 1990

[54] POLARIZERS WITH ALTERNATINGLY CIRCULAR AND RECTANGULAR WAVEGUIDE SECTIONS

[75] Inventor: Subir Ghosh, Kitchener, Canada

[73] Assignee: Com Dev. Ltd., Cambridge, Canada

[21] Appl. No.: 255,637

[22] Filed: Oct. 11, 1988

[30] Foreign Application Priority Data

Jul. 5, 1988 [CA] Canada ..... 571188

[51] Int. Cl.[5] ..... H01P 1/16

[52] U.S. Cl. ..... 333/21 A; 333/157; 333/239

[58] Field of Search ..... 333/21 A, 157, 208, 333/239, 242

[56] References Cited

FOREIGN PATENT DOCUMENTS 163501 8/1985 Japan ..... 333/21 A

*Primary Examiner*—Paul Gensler

*Attorney, Agent, or Firm*—Daryl W. Schnurr

[57] ABSTRACT

A polarizer has a plurality of short waveguide sections arranged so that rectangular-shaped sections alternate with circular-shaped sections. The two end sections are both circular. The rectangular sections have a minimum size at least as large as the minimum diameter of the circular sections. The size of the rectangular sections progressively changes from section to section with all sections of the polarizer being symmetrical about the centre point of the polarizer. The length of each section is less than half a wavelength at maximum operating frequency. The structure of the polarizer is simple and straightforward so that computer-aided analysis and design methods can easily be used. The polarizer has a relatively large bandwidth and can interface directly with corrugated circular waveguides.

13 Claims, 11 Drawing Sheets

PRIOR ART

PRIOR ART

POLARIZERS WITH ALTERNATINGLY CIRCULAR AND RECTANGULAR WAVEGUIDE SECTIONS

BACKGROUND OF THE INVENTION

1. Field of the Invention

This invention relates to a polarizer for controlling the state of polarization of microwave signal carrier modes in a waveguide. More particularly, this invention relates to a polarizer for optimum control of the state of polarization of a signal carrier waveguide dominant mode over a very wide bandwidth at microwave frequencies.

2. Description of the Prior Art

Since modern communication satellites have a life expectancy beyond seven years and since the beam coverage requirements for a particular satellite are constantly changing, there is a need for a certain amount of reconfigurability of antenna radiation characteristics in terms of the beam footprint on the earth's surface and the state of field polarization. Sometimes, satellites must be repositioned in orbit and as a result the radiated field polarization and beam footprint must be varied. Well-known frequency use techniques are employed to accomplish an efficient link utilization. It is also desirable to widen the bandwidth of operation for the links so that more communication traffic can be accommodated. A waveguide polarizer is one of the key components used in both satellites and ground stations for manipulation of radiated and/or received field polarization and for manipulation of beam footprint. While techniques to achieve these manipulations employing waveguide polarizers are well-known, previous polarizers are incapable of achieving acceptable electrical characteristics for use in satellite communication systems; or, they are structurally too complex and therefore extremely expensive; or, they are structurally complex and cannot be designed accurately using computerated design and analysis procedures; or, they are extremely difficult to construct accurately; or, they require conventional circular waveguides to be connected at the input and output ports; or, the insertion loss is unacceptably high; or, they have an inconvenient physical layout; or, they are not sufficiently reliable to be used in satellites; or, they require the use of transition sections at the input and output ports; or, they are unable to control the phase dispersion slope for more than one hand of polarization; or, they achievable bandwidth is not able to meet many practical requirements. Some of these prior art polarizers are shown in the drawings and discussed in relation thereto.

SUMMARY OF THE INVENTION

It is an object of the present invention to provide a waveguide polarizer that has a structure that can be constructed in a straightforward manner and is simple enough so that computer-aided analysis and design methods can be used. Further, it is an object of the present invention to provide a waveguide polarizer that has a relatively large bandwidth and can interface directly with corrugated circular waveguides.

In accordance with the present invention, a waveguide polarizer for controlling the state of polarization of signal carrier modes in a waveguide has a waveguide housing with a longitudinal axis. The waveguide housing has a plurality of short waveguide sections, each section being centred on the longitudinal axis. The waveguide sections are arranged in a first set and a second set so that the sections of the first set alternate with the sections of the second set throughout the housing. All sections of the first set have a circular cross-section and all sections of the second set have a rectangular cross-section with two transverse dimensions. The transverse dimensions are at least as large as a minimum diameter of the sections of the first set. The waveguide housing has two ends with a section from the first set being located at each end. The waveguide housing has a circular port at each end. Successive sections of the second set have at least one dimension that progressively changes from section to section. All of said sections are symmetrical about a centre point of said longitudinal axis.

BRIEF DESCRIPTION OF THE DRAWINGS

In drawings which illustrate a preferred embodiment of the invention.

DESCRIPTION OF A PREFERRED EMBODIMENT

Figure 1:
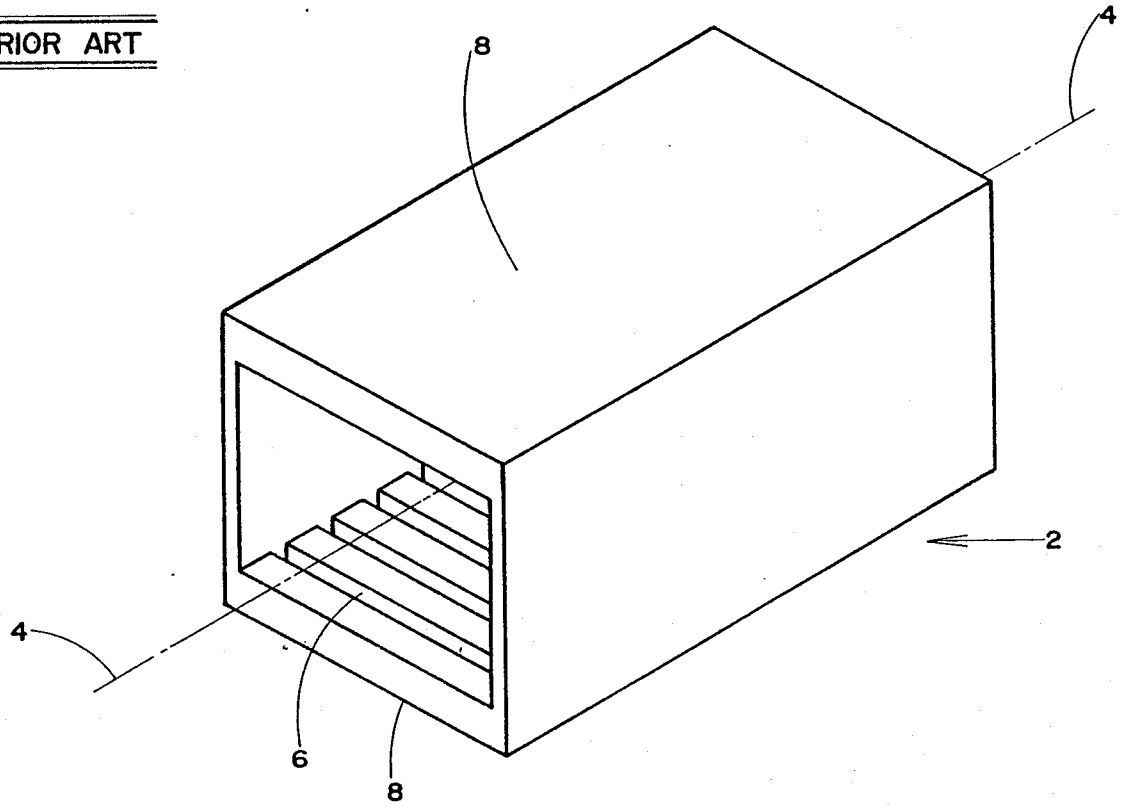
PRIOR ART FIGURE 1
FIG. 1 is a perspective view of a prior art rectangular waveguide polarizer with one pair of diametrically opposed corrugated walls.

Referring to the drawings in greater detail, in FIG. 1, a prior art waveguide polarizer 2 has a rectangular cross-section and is centred on a longitudinal axis 4. Corrugations 6 are located on two diametrically opposed walls 8, being the bottom and top walls of the polarizer.

Figure 2:
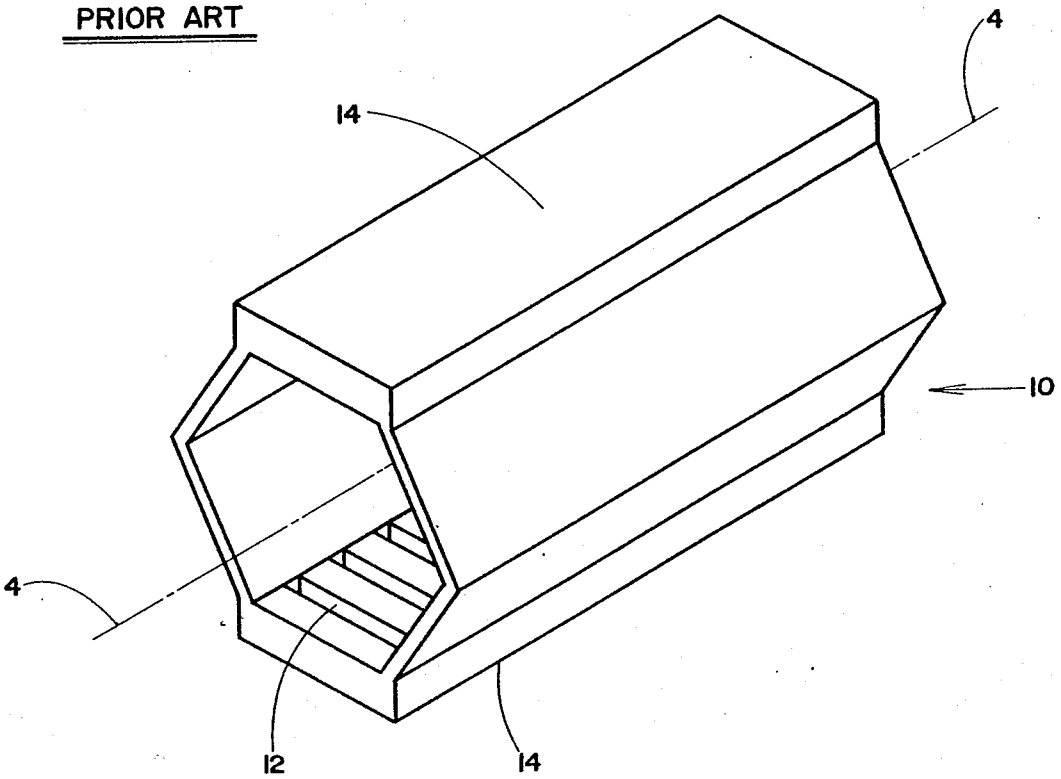
PRIOR ART FIGURE 2
FIG. 2 is a perspective view of a prior art waveguide having a hexagonal cross-section with one pair of diametrically opposed corrugated walls.

In FIG. 2, a polarizer 10 has a hexagonal cross-sectional shape with corrugations 12 on opposite top and bottom walls 14. As with the polarizer 2, the polarizer 10 is centred on the longitudinal axis 4.

Figure 3:
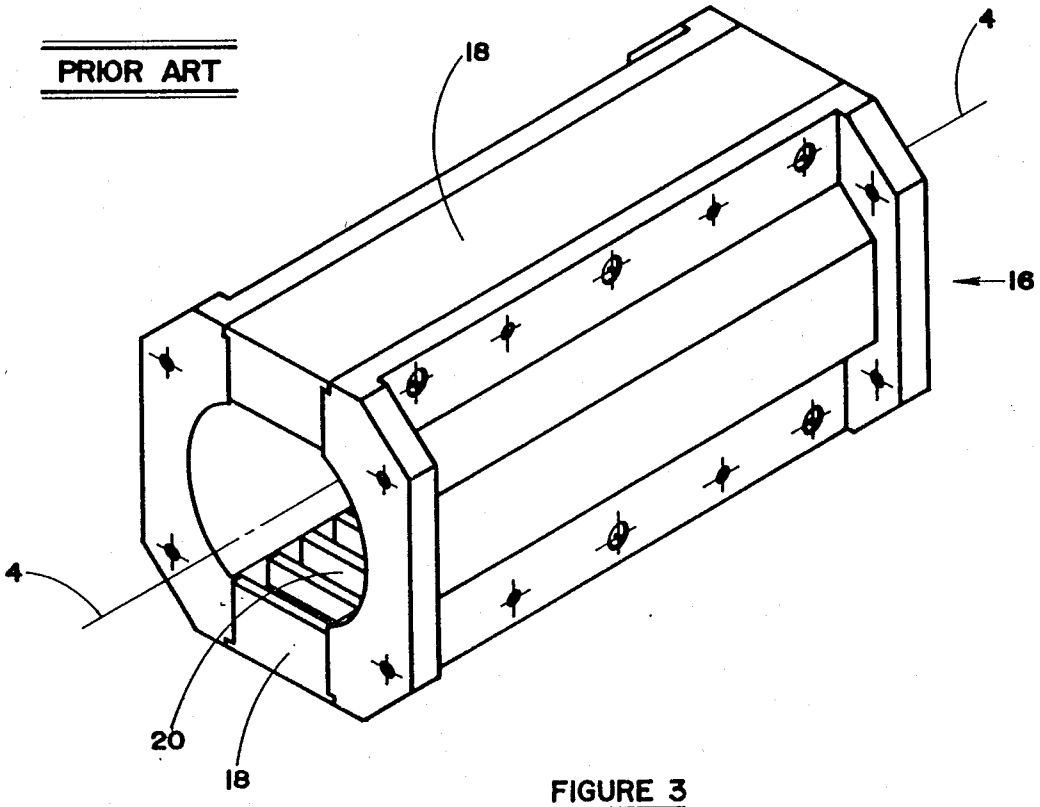
PRIOR ART FIGURE 3
FIG. 3 is a perspective view of a prior art circular waveguide polarizer having corrugations located at upper and lower sectors of the waveguide.
Figure 4:
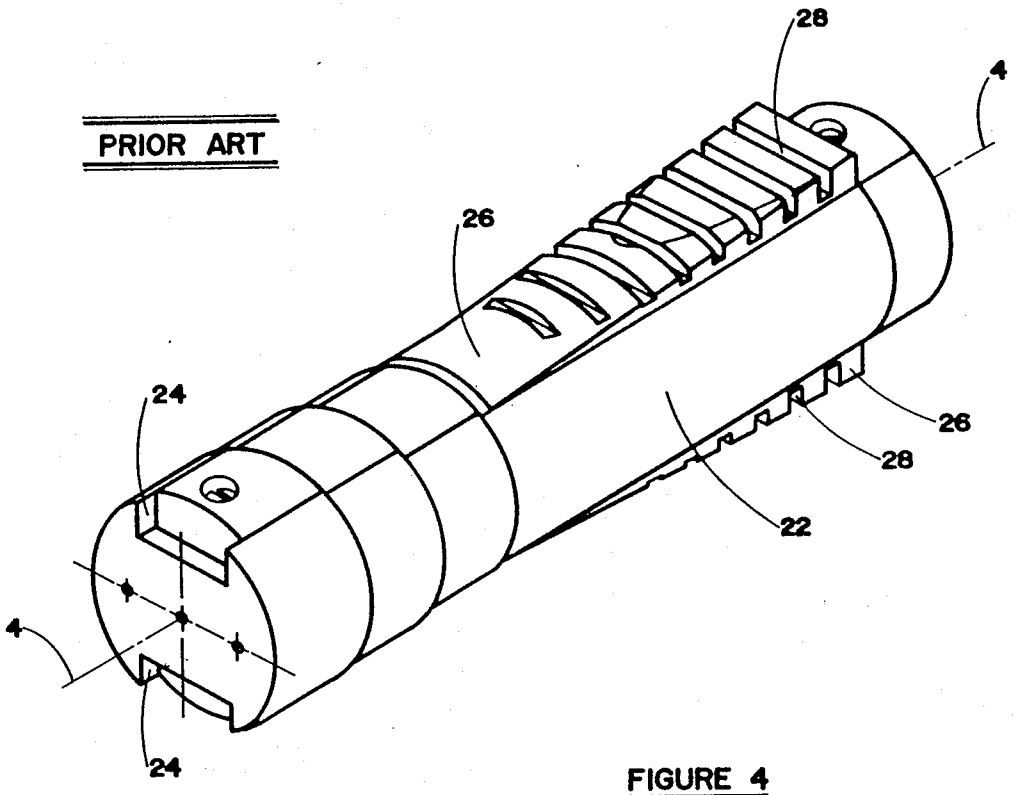
PRIOR ART FIGURE 4
FIG. 4 is a perspective view of a prior art mandrel for a transition section for the polarizer of FIG. 3.

In FIG. 3, there is shown a circular waveguide polarizer 16 centred on a longitudinal axis 4. The circular waveguide 16 is flat at two diametrically opposed sectors, being top and bottom walls 18. The walls 18 each have corrugations 20 incorporated therein. To connect the polarizer 16 with a conventional circular waveguide without any abrupt cross-sectional mismatch, a pair of suitable end transitions 22, as shown in FIG. 4, are required. The mandrel of the end transition 22 is made of a solid aluminum on which copper is electroformed. This is followed by chemically dissolving part of the aluminum mandrel to realize a transition 22 in the form of an electroformed copper shell. The fabrication of the mandrel involves several complex machining operations. First, a cylindrical block, being the body of the transition 22, is machined to the desired finished dimensions. Second, longitudinal slots 24 are cut at diametrically opposite locations running along the longitudinal axis 4 of the mandrel. Third, a pair of separate rectangular aluminum blocks 26 are placed in the slots 24 followed by additional machining operations to incorporate the tapering heights of corrugations 28.

Figure 5:
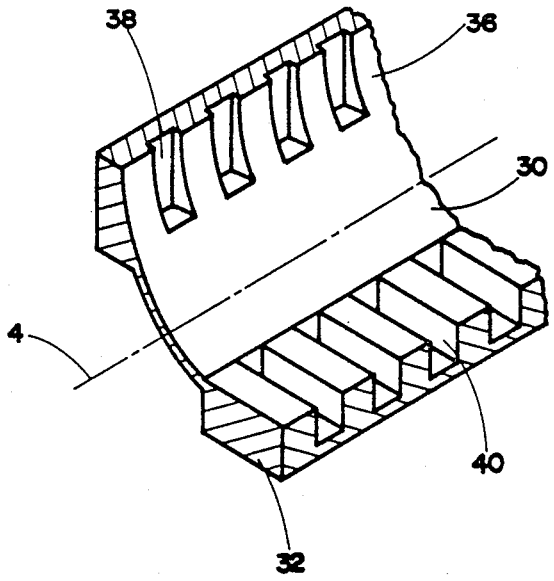
FIG. 5 is a partial cut-away perspective view of a circular waveguide polarizer having two distinct types of corrugations located on the circumference of the circular waveguide, each type of corrugation being located on two diametrically opposed sectors.
Figure 6:
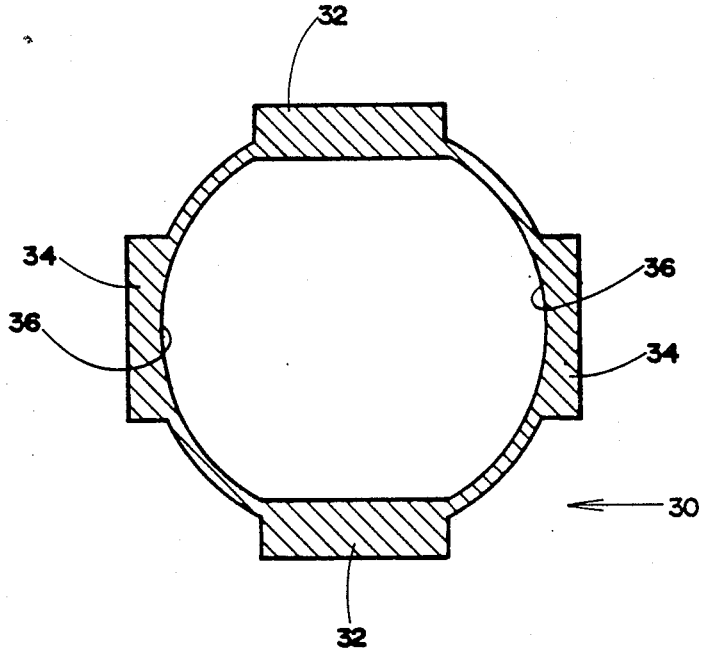
FIG. 6 is a cross-sectional view of the prior art circular waveguide polarizer of FIG. 5.

In FIGS. 5 and 6, there is shown a polarizer 30 having a circular cross-section with two flat sections at top and bottom walls 32. Side walls 34 have a circular inner surface 36 with corrugations 38 therein. The bottom and top walls 32 have corrugations 40 therein. The corrugations 38 are different from the corrugations 40 as can be readily seen from FIG. 5. FIG. 6 is the last prior art polarizer.

Any state of polarization can be decomposed into two orthogonal linear hands of polarization. Therefore, the operation of the polarizer of the present invention is described based on these two orthogonal hands of polarization. Those skilled in the art will readily recognize that the polarizer can be used to create virtually any type of polarization. In operation, polarizers create two distinct phase propagation constants for the two orthogonal hands of polarization of the signal carrying mode so that the required phase delay between the two hands can be realized. Prior art polarizers can be characterized as follows:

(a) periodically loaded;

(b) periodically loaded together with cavity compensators;

(c) periodically loaded together with dielectric compensators; or (d) sectorally corrugated.

All of these categories result in a polarizer which is either physically large, complex and massive or electrically unsatisfactory in terms of one or more of the following electrical characteristics, for example, insertion loss, return loss, purity of polarization state and bandwidth. Previous polarizers of the type described in the above categories do not allow sufficient control on the dispersion slope for the two hands of orthogonally polarized modes to produce optimum electrical characteristics in a compact and simple design. Further, prior art polarizers are usually designed by impirical methods leading to unsatisfactory results and requiring a considerable amount of time and expense.

There are prior art polarizers that have circular ports and can be interfaced easily with circular cross-section waveguides. However, none of these polarizers achieves the electrical characteristics necessary for many applications that are standard in satellite communication up-link and down-link bands.

Figure 7:
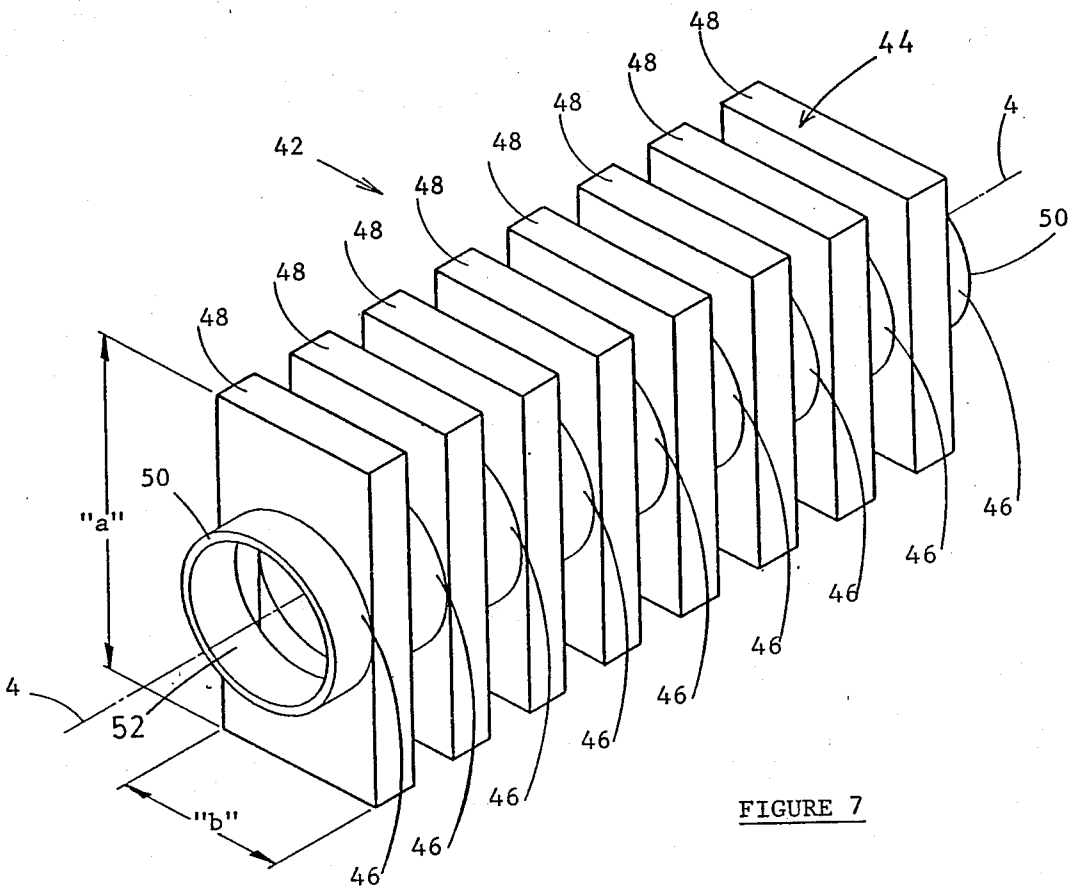
FIG. 7 is a perspective view of a polarizer in accordance with the present invention.
Figure 8:
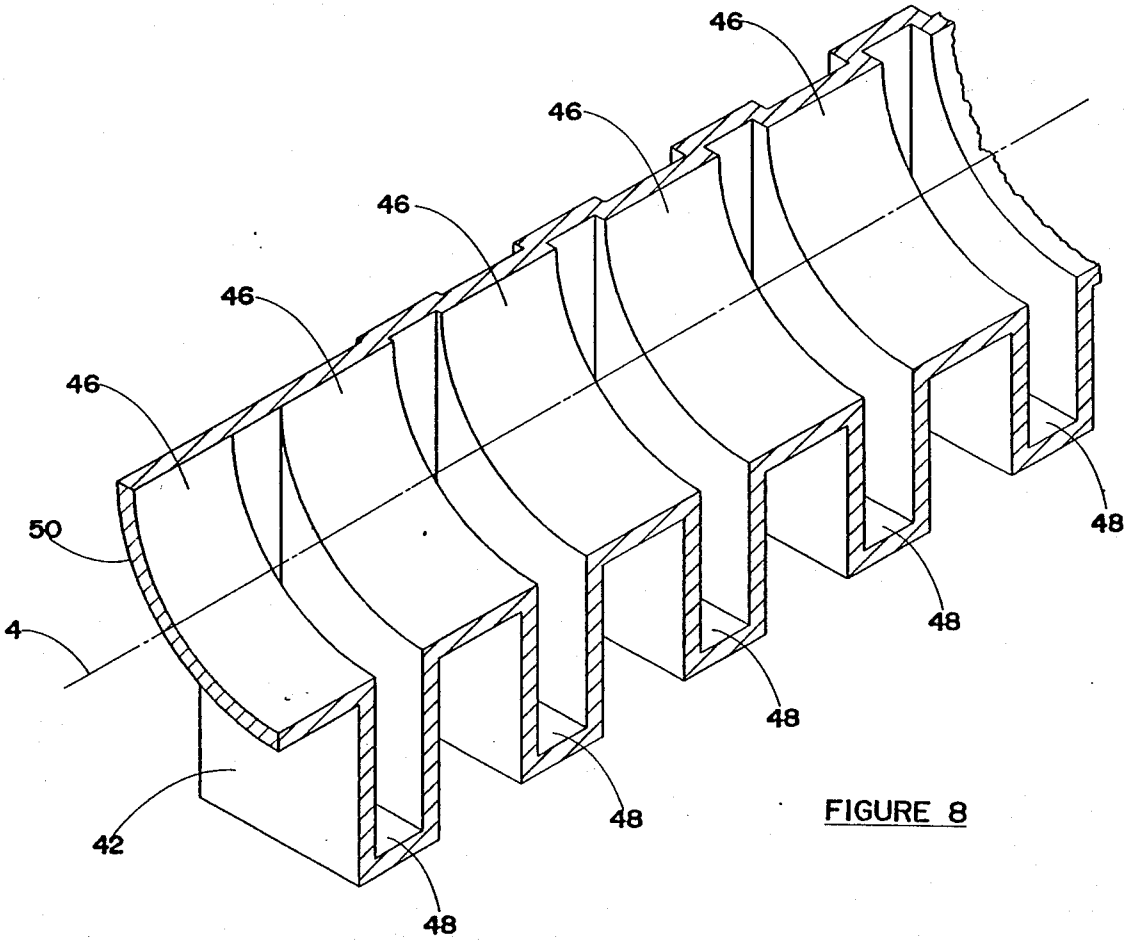
FIG. 8 is a partial cut-away perspective view of an interior of the polarizer of FIG. 7.

In FIGS. 7 and 8, there is shown a polarizer 42 having a waveguide housing 44 with a longitudinal axis 4. The housing 44 has a plurality of short waveguide sections which have either a circular or rectangular cross-section. The circular sections 46 form a first set and the rectangular sections 48 form a second set. The sections 46 of the first set alternate with the sections 48 of the second set throughout the housing 44. The housing 44 has two ends with a circular section 46 of the first set being located at each end 50 of the housing 44. At each end 50, in the circular end section 46, there is located a circular port 52. Each rectangular section 48 has an 'a' dimension and a 'b' dimension, the 'a' dimension usually being larger than the 'b' dimension. It is not essential that the waveguide sections 46, 48 have the same length as long as they are very short, typically being less than half a wavelength at the highest operating frequency along the longitudinal axis 4. Individual circular sections 46 and individual rectangular sections 48 also do not have to be the same length as long as they are short. The polarizer 42 has nine sections of the first set and eight sections of the second set.

Figure 9:
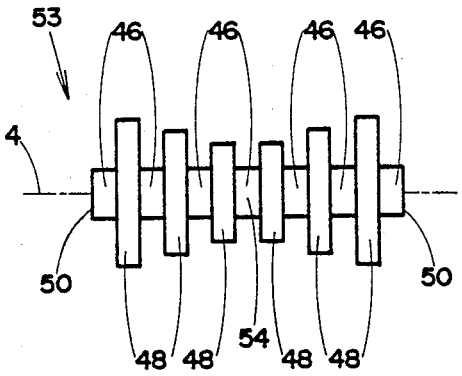
FIG. 9 is a schematic view of a side elevation of a further embodiment of a polarizer.
Figure 10:
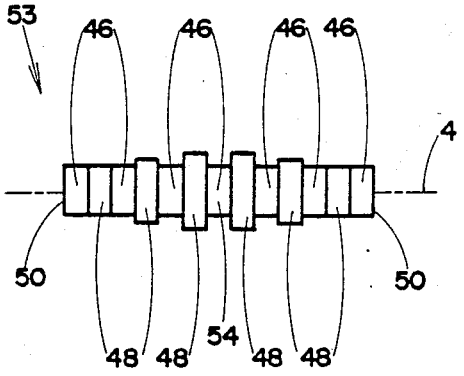
FIG. 10 is a schematic view of a top elevation of the polarizer shown in FIG. 9.

In a polarizer 53 shown in FIGS. 9 and 10, the circular waveguides 46 undergo very little change in diameter over the entire length of the device. The rectangular sections 48 undergo a noticeable change in the side elevation shown in FIG. 9 and a much lesser change in the top elevation shown in FIG. 10. In other words, the rectangular sections 48 undergo a relatively large change in the 'a' dimension and a relatively small change in the 'b' dimension. It can be seen that successive sections of the second set, being the rectangular sections 48 change progressively in the 'a' dimension from section to section. In particular, the 'a' dimension increases from a centre point 54 of the longitudinal axis 4 towards each end 50. In the top elevation, the successive sections 48 also change progressively from section to section, said sections 48 decreasing slightly from a centre point 54 to the ends 50. All of the sections 46, 48 are symmetrical about the centre point 54 of the longitudinal axis. In other words, as one moves away from the end ports 50, there is a reduction in the 'a' dimension and an increase in the 'b' dimension along the longitudinal axis 4.

Figure 11:
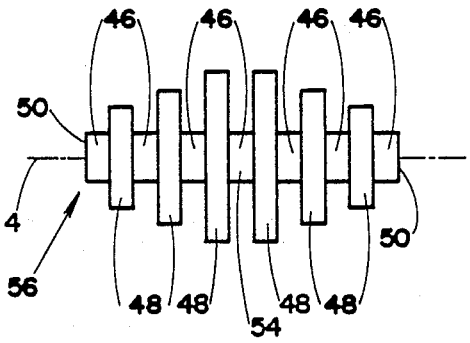
FIG. 11 is a schematic view of a side elevation of a further embodiment of a polarizer.
Figure 12:
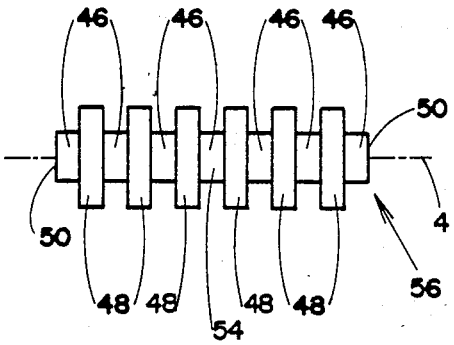
FIG. 12 is a schematic view of a top elevation of the polarizer shown in FIG. 11.

In FIGS. 11 and 12, there is shown a polarizer 56, which is a variation from the polarizer 53 shown in FIGS. 9 and 10. FIG. 11 shows a side elevation and FIG. 12 shows a top elevation of the polarizer 56. It can be seen that the dimensions 'a' and 'b' are identical at the ends 50 and the dimension 'b' is essentially constant over the length of the polarizer with the dimension 'a' undergoing an increase as one moves away from the end ports. The polarizer 56 is designed to be directly connected into corrugated circular waveguides at its end ports (not shown) in FIGS. 11 and 12.

The polarizers of the present invention have sections of simple geometric shapes that lend themselves to rigorous computer-aided design and analysis procedures. Therefore, the polarizers can be designed to achieve optimum results.

Figure 13:
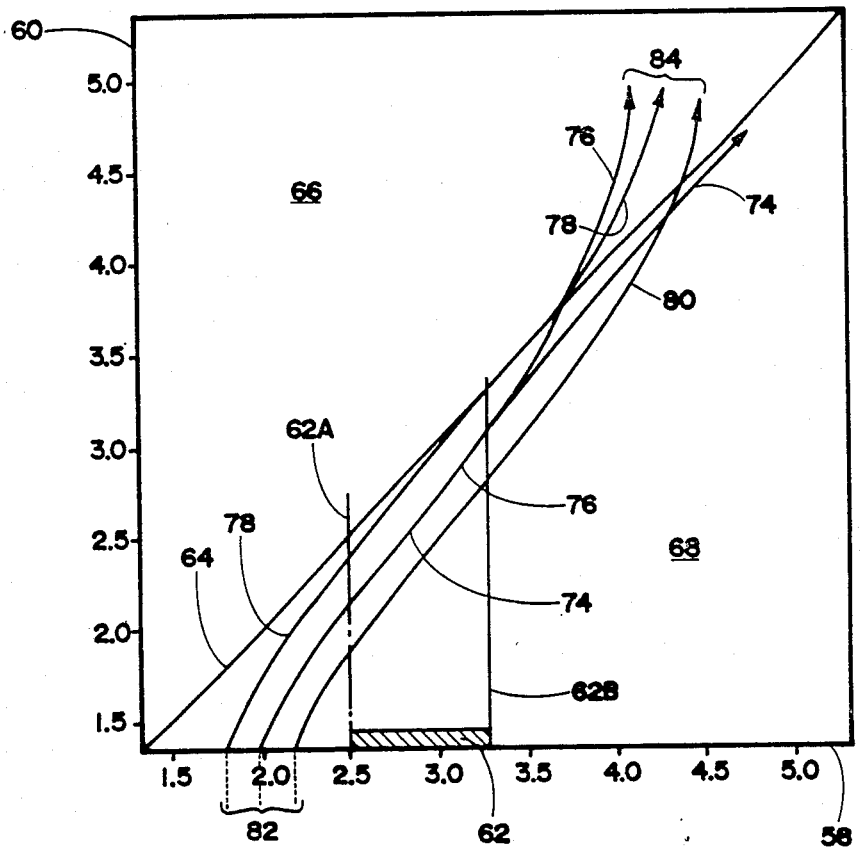
FIG. 13 is a graphical representation of the phase dispersion characteristics of the microwave signals for the polarizer shown in FIG. 7.

In FIG. 13, there is shown a graphical representation of the phase dispersion characteristics of the signal carrying dominant modes of two orthogonal linear polarizations for the polarizer 53 shown in FIGS. 9 and 10. The horizontal axis 58 of FIG. 13 shows the product of a free space phase delay in radians per unit length and the internal radius of the circular waveguide sections 46 as a function of frequency. The vertical axis 60 shows the product of modal phase delay inside the polarizer 53 in the same units as applicable to axis 58. The shaded region 62 bounded by two vertically drawn lines 62A and 62B at the extremeties of said region describes the domain of successful operation for the device and it directly reflects the bandwidth available for the polarizer 53. The diagonally placed straight line 64 divides the entire area of the graph into regions 66 and 68. The region 66 is known as the "slow-wave" region while the region 68 is called the "fast-wave" region. The set of partly overlapping curves 74, 76, 78 and 80 describes the modal phase delay behaviour, more commonly known as phase dispersion characteristics, for the polarizer 53. Any point on any one of these curves has a pair of measured values on the two axes 58, 60. The measured value on the axis 58 can be directly co-related to give the frequency of operation while the measured value on the axis 60 can be used to find the modal phase delay at that frequency. The set of points 82 at the intersection of the curves 74, 76, 78, 80 with the axis 58 are called the "low cut-off points". The set of arrowheads 84 showing the sharp rise into the slow-wave region 66 are called the "high cut-off" points.

Curve 74 represents the dispersion characteristics of the signal carrying dominant mode near the end ports of the polarizer 53 for a first linear polarization of the mode fields so that the modal electric field configuration is predominantly controlled by the 'b' dimension of the rectangular waveguide sections 48 shown in FIG. 10. The curve 76 represents the dispersion characteristics of the signal carrying dominant mode near the end ports of the polarizer 53 for a second linear polarization of the mode fields, being orthogonal to the linear polarization described for curve 74, so that the modal electric field configuration is predominantly controlled by the 'a' dimension of the rectangular waveguide sections 48 shown in FIG. 9. It should be noted that the curves 74, 76 overlap with one another within the band of interest 62. Further, the curves 74, 76 near the end ports of the device represent very closely the dispersion characteristics of the input and output conventional circular waveguides, thereby making it easy to ascertain proper match conditions for the modal signals within the band of interest 62.

In the area of the centre point 54 of the polarizer 53 the mode dispersion curve for the first polarization is the curve 78 and for the second polarization is the curve 80. Between the ends 50 and the centre point 54, the mode dispersion curve for the first polarization shifts from the curve 74 to the curve 78. Similarly, for the second polarization, the curve 76 shifts to the curve 80. For the successful operation of a polarizer device over a particular band of interest, it is essential that the curves 74, 76, 78, 80 remain parallel in the region bounded by the two vertical lines 62A and 62B. The control on the high and low cut-off frequencies shown by 82 and 84 is an important tool for realizing the required extent of parallelness between these curves. This important flexibility is provided for the polarizer 53 through adjustments in the dimensions of the successive rectangular waveguide sections 48. The underlying design consideration leading to proper dimensions of the successive rectangular waveguide sections in a polarizer device is discussed below. To attain the desired state of polarization, the overall length of the polarizer 53 is adjusted.

Figure 14:
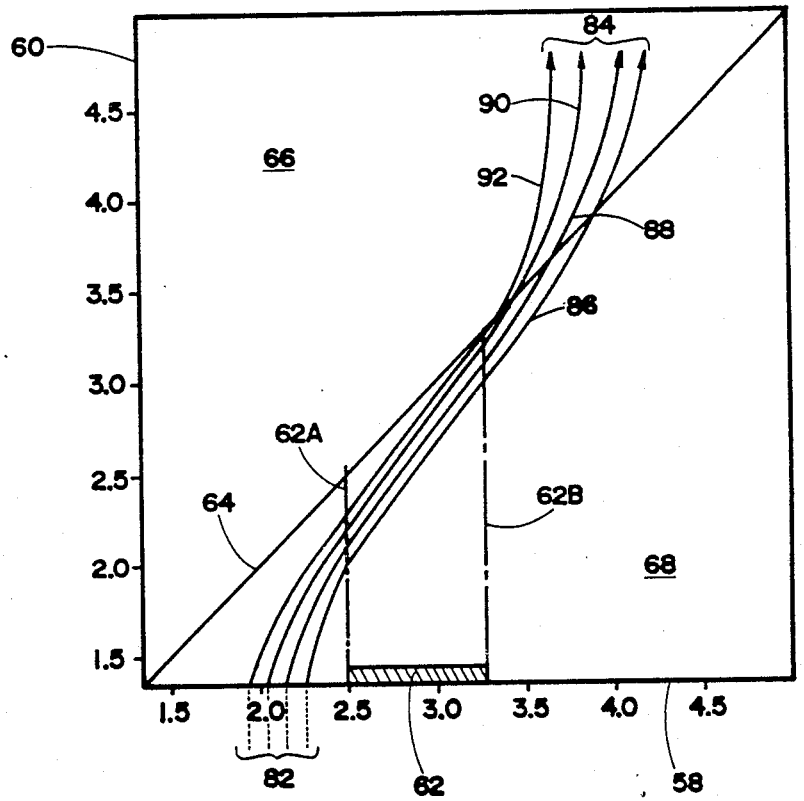
FIG. 14 is a graphical representation of the phase dispersion characteristics of the microwave signals for the polarizer shown in FIGS. 11 and 12.

FIG. 14 is a graphical representation of the phase dispersion characteristics of the signal carrying dominant modes of two linear orthogonal polarizations for the polarizer 56 shown in FIGS. 11 and 12. The same reference numerals are used in FIG. 14 as those used in FIG. 13 to describe those features that are identical. The only difference between the two FIGS. 13 and 14 lies in the dispersion curves. In FIG. 14, there are four dispersion curves 86, 88, 90, 92. For the same reasons as discussed with respect to FIG. 13, it should be noted that the curves 86, 88, 90, 92 are parallel to each other between the vertical lines 62A, 62B. The polarizer 56 is designed to interface with corrugated circular waveguides at the input and output ports. Therefore, near the end ports of the polarizer 56, the curve 86 describes the dispersion characteristics of the signal carrying mode of both polarizations. The phase dispersion curve 86 is in close agreement with the corresponding phase dispersion curve for the corrugated circular waveguide signal carrying mode at the input and output ports so that a proper matched condition for the modal signals within the band of interest can be readily attained. In the region of the centre point 54 of the polarizer 56 the mode dispersion curve for one of the two orthogonal hands of polarization is the curve 92. Between the end ports 50 and the centre point 54, the mode dispersion curve shifts from the curve 86, through the curves 88, 90 until the curve 92 is reached. This shift is caused by increasing one of the two dimensions 'a' or 'b' of the successive rectangular waveguide sections of the polarizer 56. In this particular embodiment, as shown in FIGS. 11 and 12, the 'a' dimension increases for the rectangular waveguide sections 48 from the ends 50 to the centre point 54. For the second orthogonal polarization of the polarizer 56, the dispersion curve is held stationary on the curve 86 and does not shift from that curve. For this purpose, the second of the two dimensions 'a' and 'b' of the successive rectangular waveguide sections 48 are held constant. In this particular embodiment, the dimension 'b' as shown in FIG. 12 is constant. As with the polarizer 53, in order to attain the requisite phase delay between the two orthogonal hands of polarization of the signal carrying modes, an appropriate length of the polarizer 56 is chosen.

To assist in understanding the invention, some of the underlying principles related to the operation of the polarizer will now be discussed. The phase dispersion curves of the signal carrying unity azimuthal dominant mode of a specific linear polarization is predominantly influenced by one of the two transverse dimensions of the successive rectangular waveguides. This may be substantiated as follows. Since the extension of the circular and rectangular waveguide sections is small along the axis of the device, therefore, the device may be viewed as a periodic structure where rectangular waveguide sections can be considered as the means for providing a corrugation boundary. Furthermore, due to the non-identical transverse dimensions 'a' and 'b' of the rectangular waveguide sections, the so formed corrugations would have a distinct effective depth when seen along these two virtually orthogonal transverse dimensions.

The effective depth of the corrugations in a corrugated periodic waveguide configuration determines the nature of boundary condition in terms of its capacitively or inductively reactive admittance. A capacitive boundary condition leads to concentration of energy near the central axis of the device together with a lowering of effective phase propagation constant of the particular signal carrying mode. On the other hand, an inductive boundary condition leads to concentration of energy near the boundary together with a raising of effective phase propagation constant of the particular signal carrying mode. In each of the above two situations, depending on the effective depth of the corrugations presented to a particular polarization of the signal carrying mode, the phase dispersion curves have a distinct "low cut-off point" and a distinct "high cut-off point", as discussed in FIGS. 13 and 14.

A capacitive corrugation boundary condition can be achieved by employing corrugations with effective depths typically between a quarter and a half wavelength. On the other hand, effective depths of corrugations smaller than a quarter wavelength or, greater than a half wavelength but smaller than three- quarters of a wavelength, would give rise to an inductive boundary condition. Thus, the distinct 'a' and 'b' dimensions of the rectangular waveguides can be used as a means of providing a distinct corrugation boundary condition for the two orthogonal bands of linearly polarized unity azimuthal signal carrier dominant modes. This allows independent control of the phase dispersion curves for the two orthogonally polarized modes mentioned above. Hence, the dispersion curves can be set to be displaced and yet closely parallel to each other over the bands of interest. For this purpose a proper choice of the various available dimensional parameters of the rectangular and circular waveguide sections, based on the above outlined principles, must be made.

Lastly, it is desired that the rectangular waveguide transverse dimensions 'a' and 'b' are progressively altered near the end ports of the device in a distinct fashion so that a satisfactory matching condition can be offered equally to the two orthogonal bands of signal carrying mode polarizations. This manipulation is primarily based on well known principles for matching the capacitive or inductive boundary conditions into the requisite boundary conditions presented by the input and output waveguide ports. Specifically, a capacitive boundary condition is matched by one or both of the following schemes:

(a) progressively increasing the effective depth of corrugation towards half wavelength;

(b) progressively increasing the effective wall thickness in relation to the corrugation slot gap.

Conversely, an inductive boundary condition is matched by one or both of the following schemes:

(a) progressively decreasing the effective depth of corrugations toward zero or half wavelength;

(b) progressively increasing the effective wall thickness in relation to the corrugation slot gap.

A person skilled in the art is well aware of such procedures and the particular restrictions that must be obeyed to avoid slow waves and overmoding.

Although the above discussion provides a sufficient understanding of the principle of operation of the device, there are, nevertheless, several second order effects which must be accurately taken into account in order to best exploit the potentially available useful bandwidth of operation in a polarizer of the present invention. An appropriate design and analysis tool for this purpose would have to rely on computer-aided procedures employing a rigorous field theory modelling. As already explained, the structure fortunately lends itself to such rigorous computer-aided design and analysis procedures due to the simplicity of the individual waveguide sections that are connected in tandem to form the total device.

Numerous variations, within the scope of the attached claims, in the polarizers described will be readily apparent to those skilled in the art. For example, a polarizer could be designed to interface with two different types of waveguides at its two end ports, for example, a conventional circular waveguide at one end port and a corrugated circular waveguide at the other end port. This type of polarizer could be used with a corrugated feed horn at one end and a duplexer or orthogonal mode transducer in conventional circular waveguide at the other end.

What I claim as my invention is:

1. A waveguide polarizer for controlling the state of polarization of signal carrier modes in a waveguide, said polarizer comprising a waveguide housing having a longitudinal axis, with a plurality of short waveguide sections, each section being centered on said longitudinal axis, said waveguide sections being arranged in a first set and a second set so that the sections of the first set alternate with the sections of the second set throughout the housing, all sections of the first set having a circular cross-section and all sections of the second set having a rectangular cross-section with two transverse dimensions, said transverse dimensions being at least as large as a minimum diameter of the sections of the first set, the waveguide housing having two ends with a section from the first set being located at each end, the waveguide housing having a circular port at each end, successive sections of the second set having at least one transverse dimension that progressively changes from section to section towards a centre point of the longitudinal axis, all of said sections being symmetrical about said centre point.

2. A polarizer as claimed in claim 1 wherein the diameter of all of the sections of the first set is substantially identical.

3. A polarizer as claimed in claim 2 wherein the length of each section is less than half a wavelength at a maximum operating frequency.

4. A polarizer as claimed in any one of claims 1, 2 or 3 wherein the sections of the second set near each port have a square cross-section.

5. A polarizer as claimed in claim 3 wherein the transverse dimensions of the sections of the second set are an 'a' dimension and a 'b' dimension, the 'a' dimension decreasing as the sections are located further away from the ports.

6. A polarizer as claimed in claim 5 wherein the sections of the second set increase in the 'b' dimension as they are located away from the ports.

7. A polarizer as claimed in claim 3 wherein the transverse dimensions of the sections of the second set increase in the 'a' dimension as the sections move away from the end ports.

8. A polarizer as claimed in claim 7 wherein the sections of the second set have a 'b' dimension that is substantially constant.

9. A polarizer as claimed in claim 5 wherein the 'b' dimension is substantially constant throughout the second set.

10. A polarizer as claimed in any one of claims 1, 2 or 3 wherein the length of each section is substantially identical.

11. A polarizer as claimed in any one of claims 1, 2 or 3 wherein the transverse dimensions of the sections of the second set are 'a' and 'b' dimensions and said dimensions are independently controlled to independently control the dispersion characteristics for each of two orthogonal linear polarizations.

12. A polarizer as claimed in any one of claims 1, 2 or 3 wherein there are an odd number of sections of the first set and an even number of sections of the second set.

13. A polarizer as claimed in any one of claims 1, 2 or 3 wherein there are seven sections of the first set and six sections of the second set.

* * * * *